United States Patent [19]

Barozzi et al.

[11] 4,445,797

[45] May 1, 1984

[54] IMPACT CONTROL FOR CARRIER MOUNTED SERIAL PRINTERS

[75] Inventors: Gian P. Barozzi; Giancarlo Horeschi, both of Tokyo, Japan

[73] Assignee: Tokyo Juki Industrial Co., Ltd., Tokyo, Japan

[21] Appl. No.: 279,074

[22] Filed: Jun. 30, 1981

[30] Foreign Application Priority Data

Jul. 11, 1980 [JP] Japan ..... 55-94939

[51] Int. Cl.[3] ..... B41J 1/60

[52] U.S. Cl. ..... 400/166; 400/162.1

[58] Field of Search ..... 400/162.1, 166

[56] References Cited

U.S. PATENT DOCUMENTS

| | | | |
|---|---|---|---|
| 2,926,768 | 3/1960 | Becker et al. | 400/162.1 X |
| 3,239,049 | 3/1966 | Voit, Jr. | 400/166 |
| 3,247,941 | 4/1966 | Beattie et al. | 400/162.1 X |
| 3,620,344 | 11/1971 | Clancy et al. | 400/166 X |
| 3,980,169 | 9/1976 | Decker et al. | 400/166 |

OTHER PUBLICATIONS

IBM Selectric Typewriter Service Manual, Revised May 1975, pp. 43–51.

*Primary Examiner*—Ernest T. Wright, Jr.
*Attorney, Agent, or Firm*—Koda and Androlia

[57] ABSTRACT

A printing device in a typewriter including a rocker bracket turned in a direction of printing by a cam rotated when a key is pressed, a type head vertically movable and rotatably supported by the rocker bracket, a vertically movable pulley and rotatable pulley which are mounted on the bracket which are connected to a letter selecting mechanism and rotated by a predetermined value in accordance with a letter selected by the key, a printing arm for pivotally supporting a trigger detachably engageable with the rocker bracket and abutting against and being rotated by the cam to turn the rocker bracket, vertical direction selecting means for moving to a predetermined position in accordance with a value of rotation of the vertically movable pulley, rotational direction selecting means provided on the rotatable pulley and a printing pressure control member for being movable in accordance with the movements of the vertical directional selecting means and the rotational direction selecting means and having at least two abutting portions within a moving path of the trigger, whereby the position of the printing pressure control member is set by the respective selecting means and the trigger is caused to impinge on a portion selected out of the abutting portions, so that a position where the rocker bracket is to be released can be adjusted to thereby enable adjustment of the printing pressure.

8 Claims, 8 Drawing Figures

IMPACT CONTROL FOR CARRIER MOUNTED SERIAL PRINTERS

BACKGROUND OF THE INVENTION

This invention relates to printing devices in typewriters, and particularly to a printing device additionally provided thereon with a printing pressure adjusting mechanism capable of adjusting a printing pressure in accordance with a printing area of the respective letters including signs in a typewriter including a ball-like type head.

Additionally, the aforesaid typewriters include various type typewriters, teletypewriters and other typewriters analogous thereto, and the aforesaid ball-like type heads include not only ordinary spherical type heads but also type heads similar in configuration thereto and cylindrical type heads.

In a typewriter provided thereon with a ball-like type head, positions of the type head in the vertical and turning directions are adapted to be indexed by a letter selecting mechanism so as to print a predetermined letter.

If letters each having a small printing area, such as a period, comma, underline and semicolon, are printed under the same printing pressures as those for other letters each having a comparatively large printing area, then there are possibilities that a typewriter paper and carbon paper are broken, or the letters having a small printing area are printed in more dark color than other letters to be considerably deteriorated in visual appearance. In addition, such disadvantages are presented that ribbons tend to be deformed, so that one ribbon cannot be used for a long period of time, thus requiring frequent changes of ribbons. Consequently, in order to obviate the abovedescribed disadvantages, low printing pressures should be applied to the letters having a small printing area.

In order to achieve this purpose, heretofore, there have been proposed printing pressure adjusting devices. In these conventional devices, when a key lever or a capital-small letter shift lever is pressed, a printing pressure adjusting mechanism is operated, transmitting this operating force to a printing mechanism so as to change the printing pressure in the printing mechanism. This arrangement has necessitated provision of a mechanism for connecting a key lever mechanism to a printing mechanism within the printing pressure adjusting mechanism, thus presenting a disadvantage of complicated construction.

SUMMARY OF THE INVENTION

The present invention has been developed to obviate the abovedescribed disadvantages of the prior art and has as its object the provision of a printing device in a typewriter, wherein a printing pressure adjusting mechanism is entirely assembled into the printing mechanism, the printing pressure adjusting mechanism is made independent of a key lever mechanism to eliminate a transmission mechanism from the key lever mechanism to the printing mechanism, and a printing pressure adjusting device simplified in construction and reliably operable is provided.

In other words, the present invention contemplates the provision of a printing device in a typewriter comprising: a rocker bracket turned in a direction of printing by a cam rotated when a key is pressed; a type head vertically movably and rotatably supported by the rocker bracket; a vertically movable pulley and a rotatable pulley which are mounted on the rocker bracket, connected to a letter selecting mechanism and adapted to be rotated by a predetermined value in accordance with a letter selected by the key; a mechanism for transmitting a movement of the vertically movable pulley to the type head to vertically move the same; and a mechanism for transmitting a movement of the rotatable pulley to the type head to rotate the same; wherein the aforesaid printing device further comprises: a printing arm for pivotally supporting a trigger detachably engageable with the rocker bracket and abutting against and being rotated by the aforesaid cam to turn the rocker bracket; vertical direction selecting means for moving to a predetermined position in accordance with a value of rotation of the vertically movable pulley; rotational direction selecting means provided on the rotatable pulley; and a printing pressure control member movable in accordance with movements of the vertical direction selecting means and the rotational direction selecting means and having at least two abutting portions within a moving path of the trigger; whereby the position of the printing pressure control member is set by the respective selecting means, and the trigger is caused to impinge on a portion selected out of the abutting portions, so that a position where the rocker bracket is to be released can be adjusted, thereby enabling the adjustment of the printing pressure.

In the abovedescribed arrangement, the mechanism for adjusting the printing pressure is entirely assembled into a printing mechanism of a carriage, and hence, is independent of a key lever mechanism, whereby no complicated transmission mechanism is required, so that a printing pressure adjusting mechanism simplified in construction and operable reliably can be obtained.

Furthermore, parts operating for adjusting the printing pressure are minimized in number and adapted to operate through selecting the vertical and rotational direction positions directly from vertical and rotational direction indexing portions, so that a printing pressure adjusting device free from malfunctions can be obtained.

Further, it becomes possible to easily and reliably adjust the printing pressure for any type of type head solely by bringing positions of letters small in printing area into registration with the position of an engageable circumferential position of the rotatable pulley. Consequently, in manufacturing the printing pressure adjusting device, only a replacement of the aforesaid cam formed with a recess with a new one depending on the specification of the type head makes it possible to easily render a printing pressure adjusting mechanism, whereby the necessity of replacing many parts is eliminated, thus facilitating the manufacture.

Moreover, the parts for connecting a mechanism for selecting a letter in the vertical direction of the type head to the printing pressure adjusting mechanism are not subjected to an urging force of a spring, whereby the parts operate smoothly and little load acts on the letter selecting mechanism, thereby enabling the simplification of the construction of the printing pressure adjusting device.

As apparent from the foregoing, according to the present invention, it becomes possible to obtain a printing device for a typewriter, including a printing pressure adjusting device assembled into a carriage together with a printing mechanism, simplified in construction and operable reliably.

BRIEF DESCRIPTION OF THE DRAWING

The accompanying drawing shows a preferred embodiment of the printing device in a typewriter according to the present invention, in which.

PREFERRED EMBODIMENT OF THE INVENTION

Figure 1:
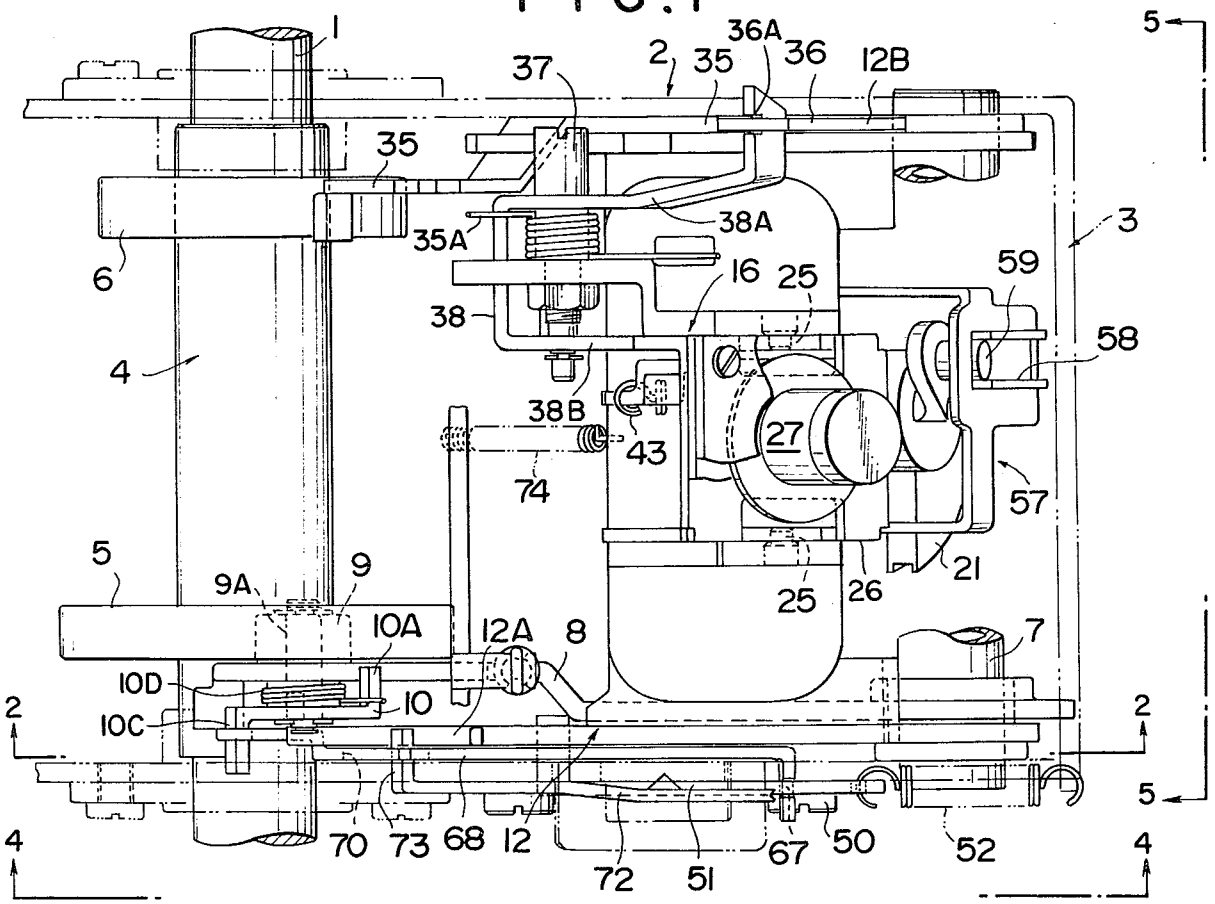
FIG. 1 is a plan view showing an embodiment of the printing device in a typewriter according to the present invention.

Description will hereunder be given of one embodiment of the present invention with reference to FIGS. 1 to 6.

As shown in the drawing, a carriage 2 is slidably supported on a main shaft 1 journalled on a frame 1A of a typewriter and rotatable by a motor 2A.

The carriage 2 includes a frame 3 and a cam sleeve 4 rotatable by the main shaft 1, and the cam sleeve 4 is provided thereon with a printing cam 5 and a detent cam 6.

Solidly secured to the frame 3 is a hollow and tubular rocker shaft 7 formed at the intermediate portion thereof with a cutout 7A, and pivotally supported on the rocker shaft 7 is a printing arm 8 rocked by the printing cam 5. A cam follower 9 which may contact the printing cam 5 is pivotally supported at the forward end of the arm 8.

Figure 2:
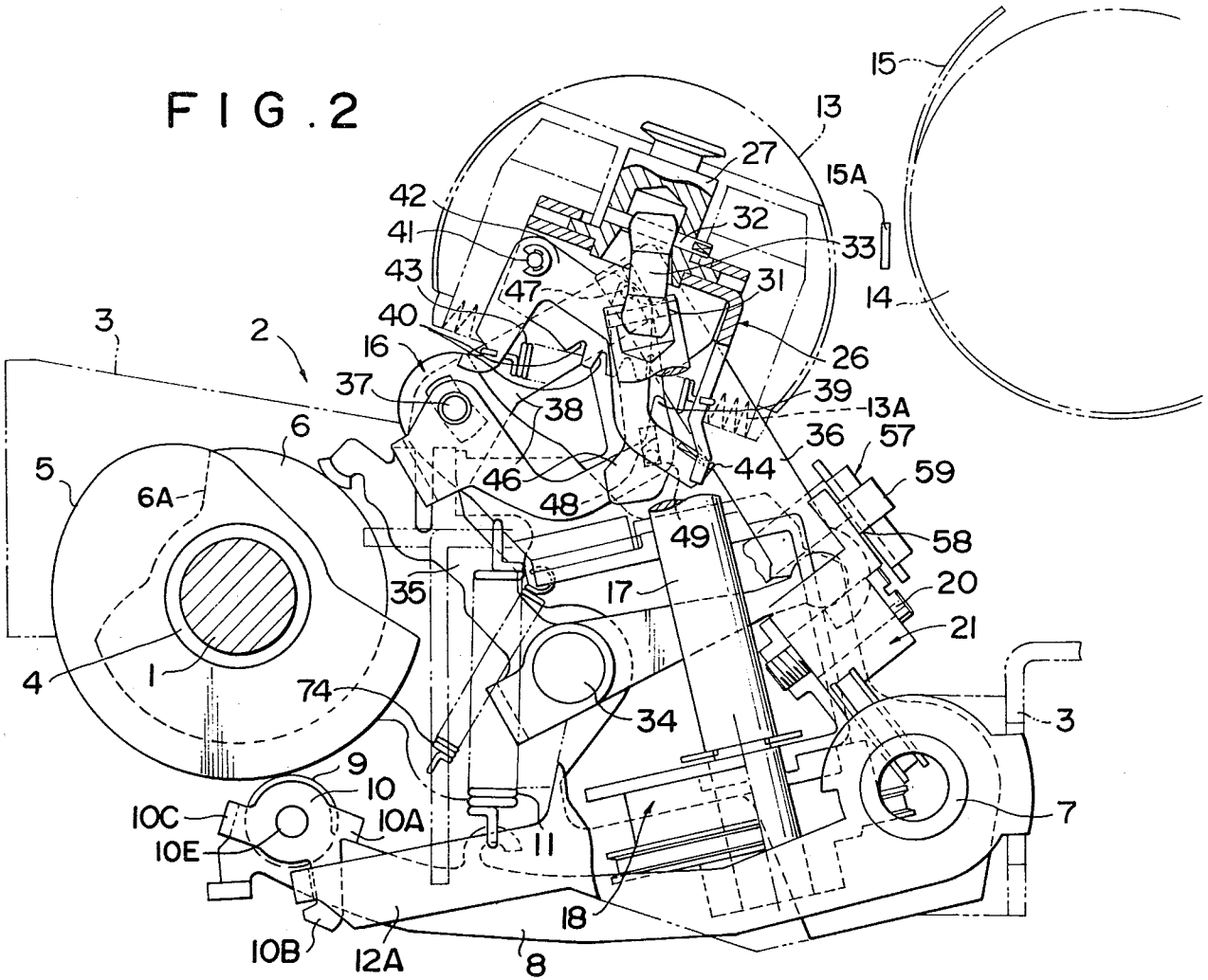
FIG. 2 is a side view taken along the line 2—2 in FIG. 1, showing the state of waiting.
Figure 3:
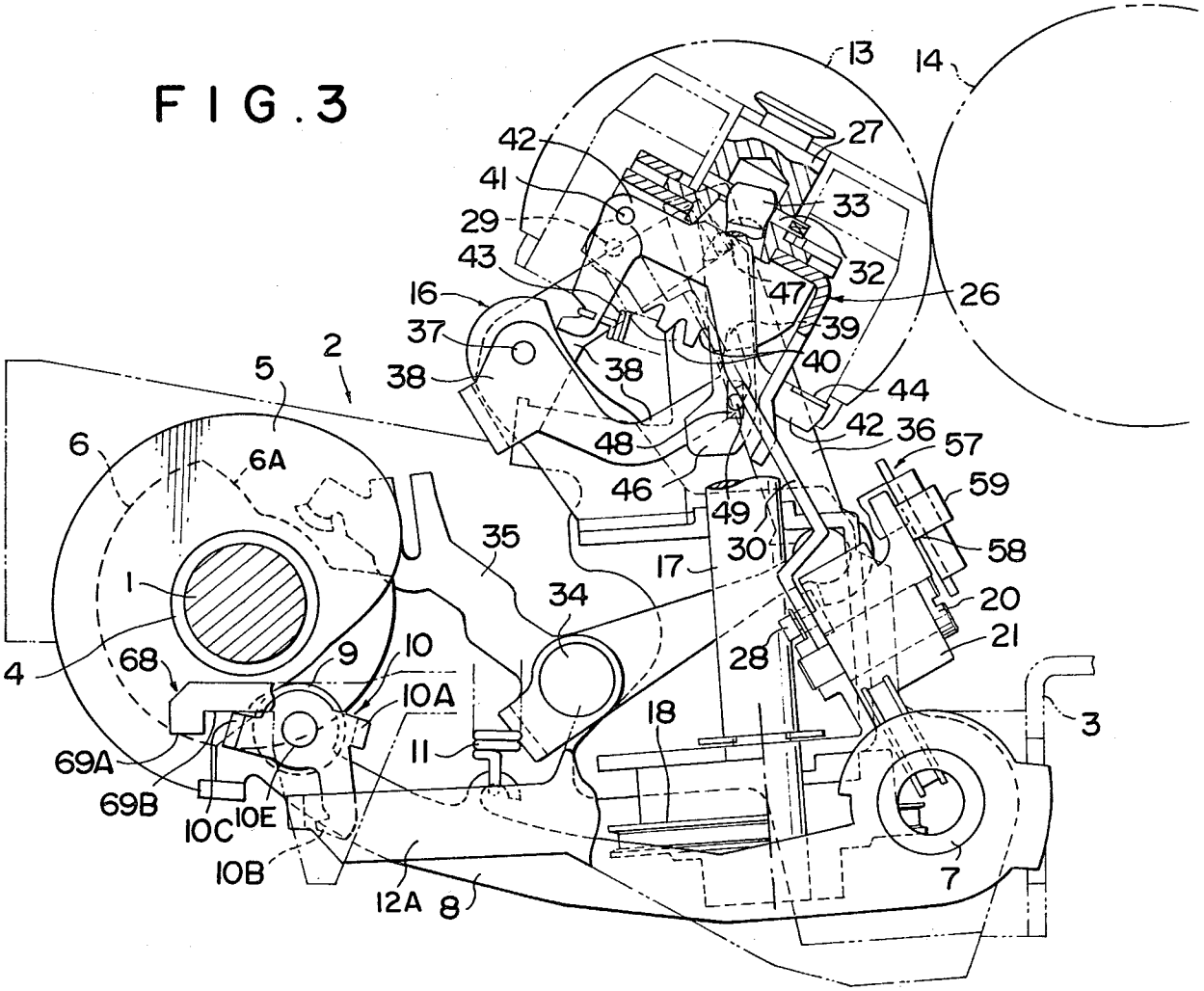
FIG. 3 is a side view taken along the line 2—2 in FIG. 1, showing the state of printing.
Figure 4:
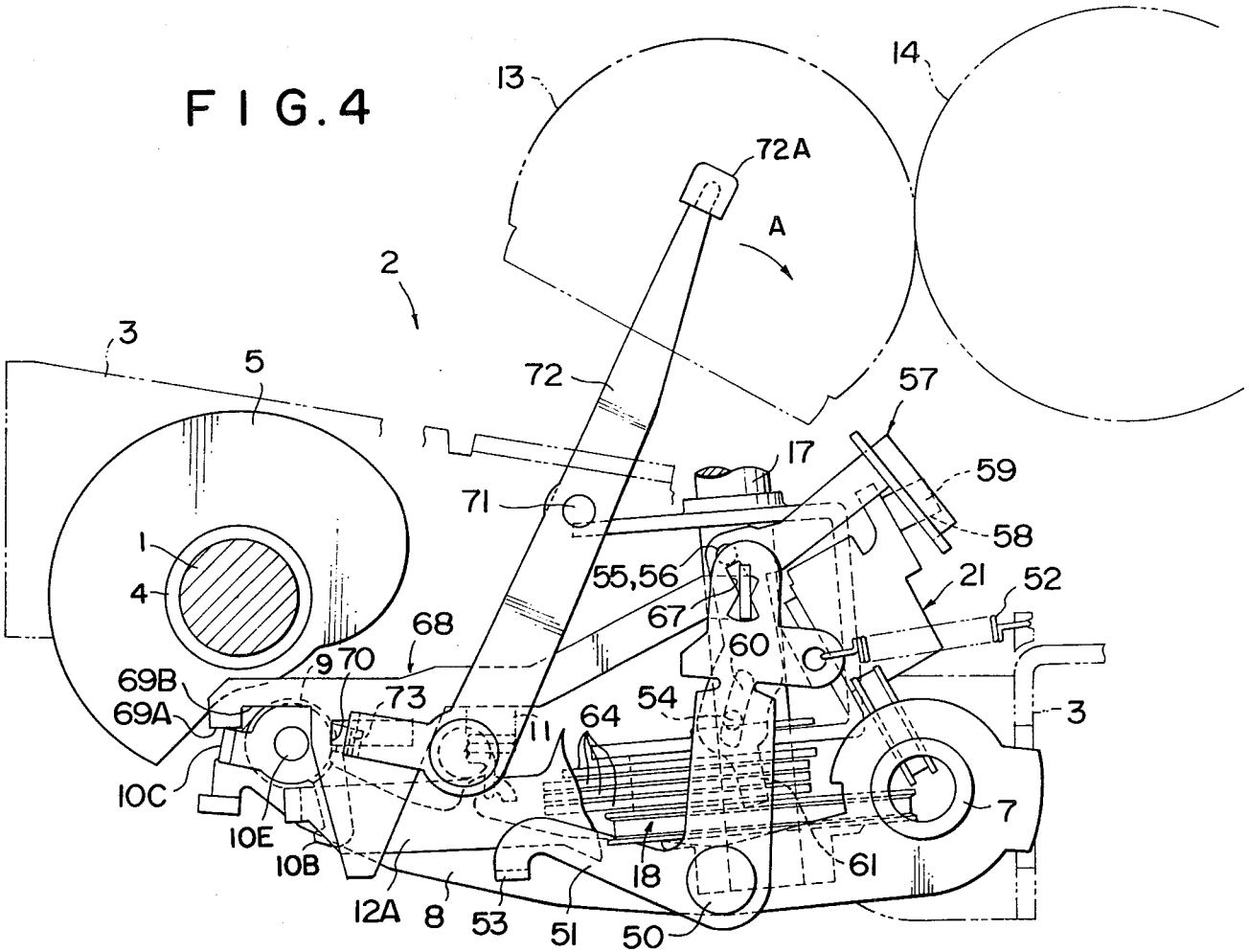
FIG. 4 is a side view taken along the line 4—4 in FIG. 1 with the frame of the typewriter being cut away, showing the state where the printing pressure is adjusted low.
Figure 5:
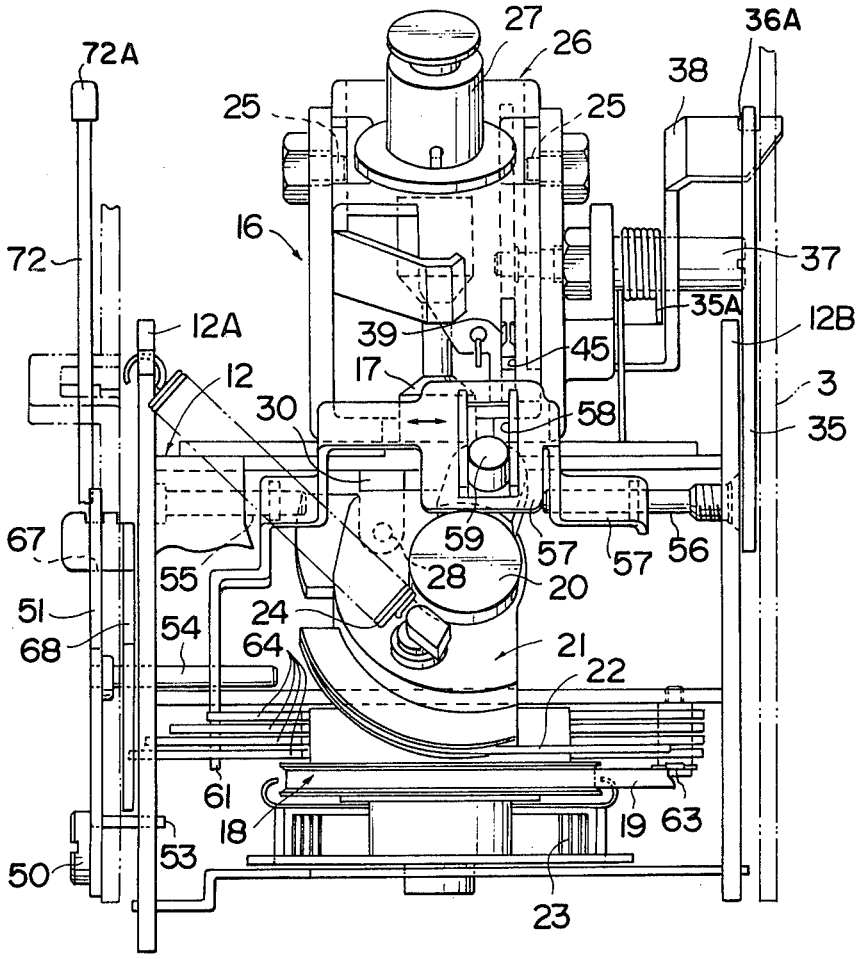
FIG. 5 is a rear view in the direction indicated by the arrows from line 5—5 in FIG. 1.

Loosely coupled to a pivot 9A of the cam follower 9 is a trigger 10 urged by spring 10D clockwise in FIGS. 2 to 4. This trigger 10 has an engageable portion 10A engageable with the printing arm 8, and during the waiting time in FIG. 2, the engageable portion 10A is engaged with the printing arm 8 to thereby prevent the trigger 10 from being rotated. Furthermore, the trigger 10 is provided thereon with engageable portions 10B and 10C which are engaged with and come into abutting contact with other members to be described hereinafter during operation.

The aforesaid printing arm 8 is urged clockwise in FIGS. 2, 3 and 4 by a spring 11 stretched between the frame 3 and itself, and consequently, adapted to rock on a circular arc following the contour of the cam 5 when the cam 5 is rotated.

Rotatably supported on the aforesaid rocker shaft 7 is a rocker bracket 12, which is provided at opposite sides thereof with plate portions 12A and 12B, and pivotally supported on the rocker shaft 7 through these plate portions 12A, 12B.

The forward end of the plate portion 12A is disposed at a position where it may be engaged with the engageable portion 10B of the trigger 10, and, when the printing arm 8 is rocked upwardly, the plate portion 12A is engaged with the engageable portion 10A, so that the rocker bracket 12 as a whole can be rotated upwardly (clockwise). In other words, a ball-like type head 13 mounted on the top portion of the rocker bracket 12 is rotated toward a paper 15 on a platen 14 to thereby print a letter.

Solidly secured to the upper portion of the rocker bracket 12 is a yoke 16.

Rotatably supported on the rocker bracket 12 is a rotate shaft 17, and secured to the lower portion of the shaft 17 is a rotate pulley 18, to which is connected one end of a rotate tape 19 connected to a letter selecting mechanism.

Pivotally supported on the rear portion of the rocker bracket 12 is a tilt pulley 21 rotatable about a shaft 20, and connected to the tilt pulley 21 is one end of a tilt tape 22 connected to the letter selecting mechanism.

Interposed between the rotate pulley 18 and the rocker bracket 12 is a spiral spring 23 (Refer to FIG. 5), which applies a predetermined value of tensile force to the rotate tape 19. Furthermore, also stretched between the aforesaid tilt pulley 21 and the rocker bracket 12 is a spring 24 (Refer to FIG. 5), which applies a predetermined value of tensile force to the tilt tape 22.

Longitudinally rockingly supported on a pivot 25 provided on the yoke 16 mounted on the aforesaid rocker bracket 12 is a tilt link 26. Additionally, a ball socket 27 rotatable about a vertical axis is mounted on the top surface of the tilt link 26. A ball-like type head 13 (having a spherical surface) is fastened to this ball socket 27 in a predetermined positional relationship therewith. And, the position of the pivot 25 of the tilt link 26 on the yoke 16 is selected such that the axis of the pivot 25 passes through the center of the spherical surface of the type head 13.

A connecting arm 30 connects a pin 28 provided at a side portion (the left side portion in FIG. 5) offset from the rotary center of the aforesaid tilt pulley 21 to a pin 29 provided on the aforesaid tilt link 26, so that the tilt link 26 can be vertically moved and also the type head 13 can be vertically moved in accordance with the rocking motion of the tilt pulley 21. This is the motion for the type head 13 to select a letter in the vertical direction.

A pin 31 is provided at the upper end of the rotate shaft 17, also a pin 32 is formed at the lower portion of the ball socket 27, and these pins 31 and 32 are jointed by a ball joint 33 in such a manner that rotation of the rotate shaft 17 is reliably imparted to the ball socket 27, while the ball socket 27 is permitted to make vertical movement (rocking in the forward and rearward directions). Consequently, rotation of the rotate pulley 18 is reliably imparted to the aforesaid type head 13. This is the motion for the type head 13 to select a letter in the rotational direction.

Description will now be given of a detent (indexing) mechanism during the vertical movement and rotation of the type head 13.

A bell crank-shaped cam follower 35 is rockingly supported on a pivot 34 provided at the left side of the frame 3 of the carriage 2, and this cam follower 35 is urged by a spring 35A counterclockwise with one end thereof being brought into abutting contact with the cam surface of the aforesaid detent cam 6.

The other end of the cam follower 35 is connected to the lower end of the link 36 (Refer to FIG. 3). A tilt detent lever 38 is rockingly supported on a pivot 37 provided on the yoke 16.

The tilt detent lever 38 has bifurcated portions 38A, 38B, one portion (upper one) 38A of which is engaged at the forward end thereof with a notch 36A disposed close to the upper end of the link 36, and the other portion 38B is engageable with any one of a plurality of grooves 40 formed in the aforesaid tilt link 26.

Rockingly supported on a pivot 41 provided on the aforesaid tilt link 26 in a rotate detent lever 42, which is urged by a spring 43 in the counterclockwise direction. The forward end 44 of this rotate detent lever 42 is guided in the vertical direction along a groove portion 45 of the tilt link 26 and engageable with one of grooves 13A, of the type head 13.

The end portion 39 of the tilt detent lever 38 is engaged with one of the grooves 40 of the tilt link 26, whereby indexing is made in the vertical movement of the type head 13. Likewise, the forward end 44 of the rotate detent lever 42 is engaged with one of the grooves 13A of the type head 13, whereby indexing is made in the rotational direction of the type head 13.

A link 46 is provided between the rotate detent lever 42 and the tilt detent lever 38. The link 46 is connected at the upper end thereof to the rotate detent lever 42 through a pin 47, and a pin 49 of the tilt detent lever 38 is coupled into a slot 48 formed close to the lower end of the link 46.

The arrangement of the printing device has been described hereinabove, and the arrangement of the printing pressure adjusting device will now be described.

A velocity lever 51 capable of rocking about a pivot 50 is provided on the exterior of the right side surface of the frame 3 of the carriage 2. This velocity lever 51 is urged by a spring 52 in the clockwise direction, and mounted such that the forward end 53 comes into abutting contact with the undersurface of the rocker bracket 12 to be stopped. Furthermore, a guide rod 54 being of a predetermined length is solidly secured to the inner surface of the velocity lever 51.

Guide rods 55 and 56 each being of a predetermined length and projected inwardly are provided at opposite sides of the rocker bracket 12, and a bell crank 57 laterally movable along these guide rods 55 and 56 is provided. A groove hole 58 is formed in a right-left connecting portion of this bell crank 57, and a pin 59 of the tilt pulley 21 is coupled into the groove hole 58. In consequence, when the tilt pulley 21 rocks, the bell crank 57 is laterally moved along the guide rods 55 and 56. A circular arcuate slot 60 centering about the aforesaid rocker shaft 7 is formed at one side of this bell crank 57, and the guide rod 54 of the aforesaid velocity lever 51 is coupled into this slot 60. Even if the bell crank 57 is moved to the right or left, this guide rod 54 is constantly coupled in the slot 60. Additionally, an engageable portion 61 is formed at the right lower end of the bell crank 57.

A recess 62 is formed on the aforesaid rotate pulley 18 at a specific circumferential position selected in consideration of the positions in rotational direction of letters each having a small printing area on the type head 13.

Figure 6:
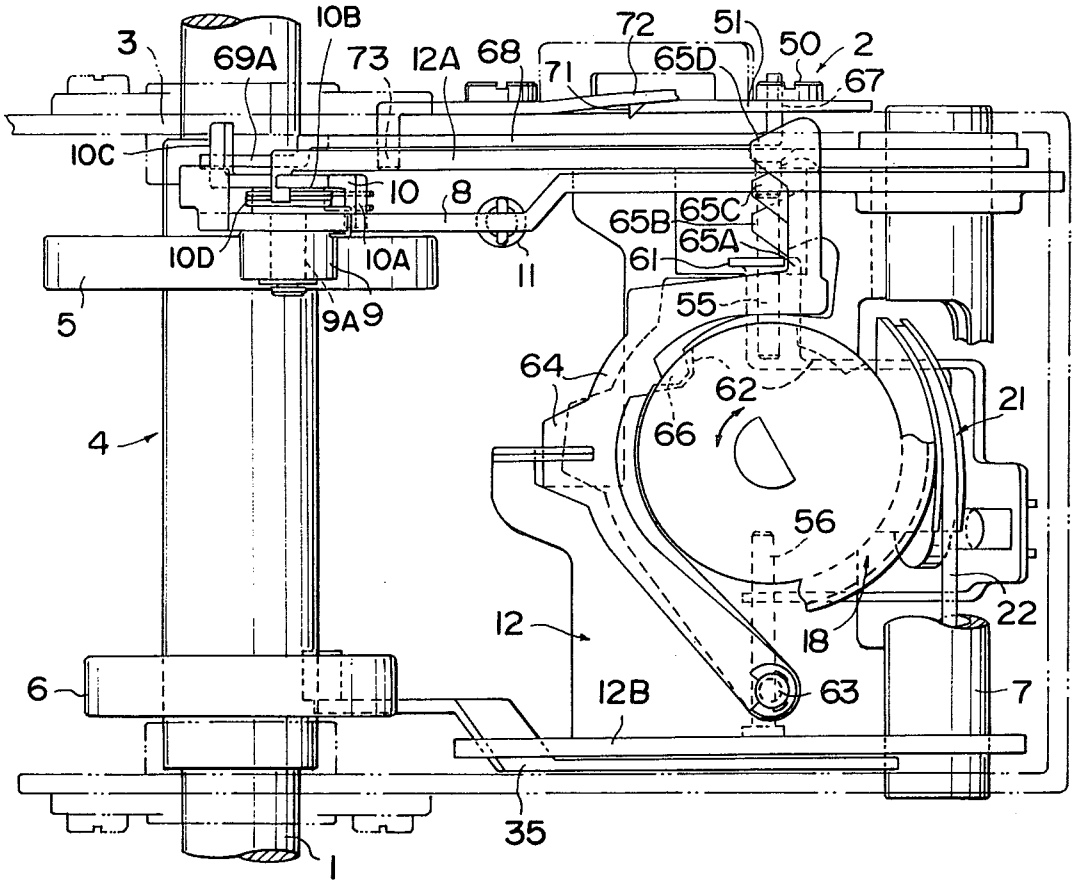
FIG. 6 is a bottom view of FIG. 1.
Figure 7:
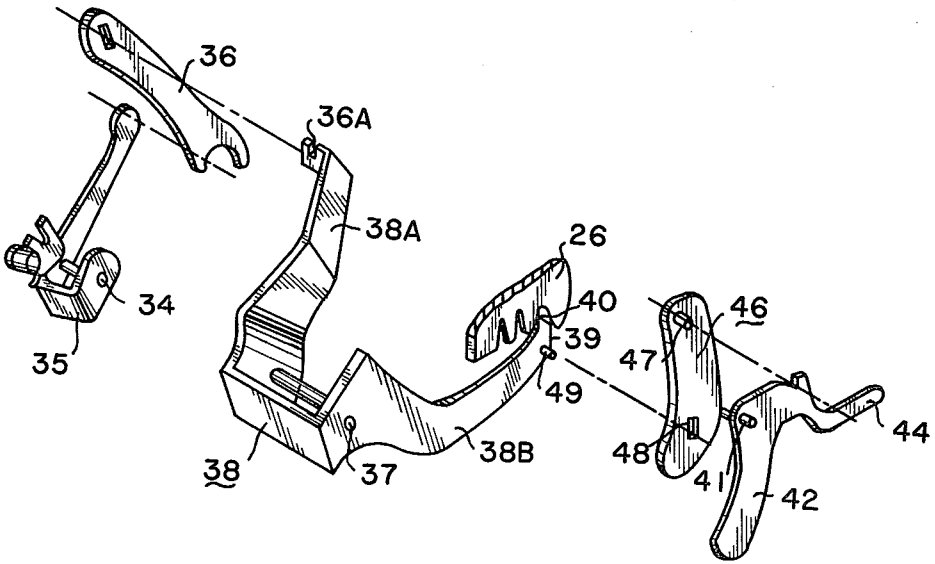
FIG. 7 is an exploded, partial view illustrating the configuration and connection of a portion of the printing device in a typewriter according to the present invention.
Figure 8:
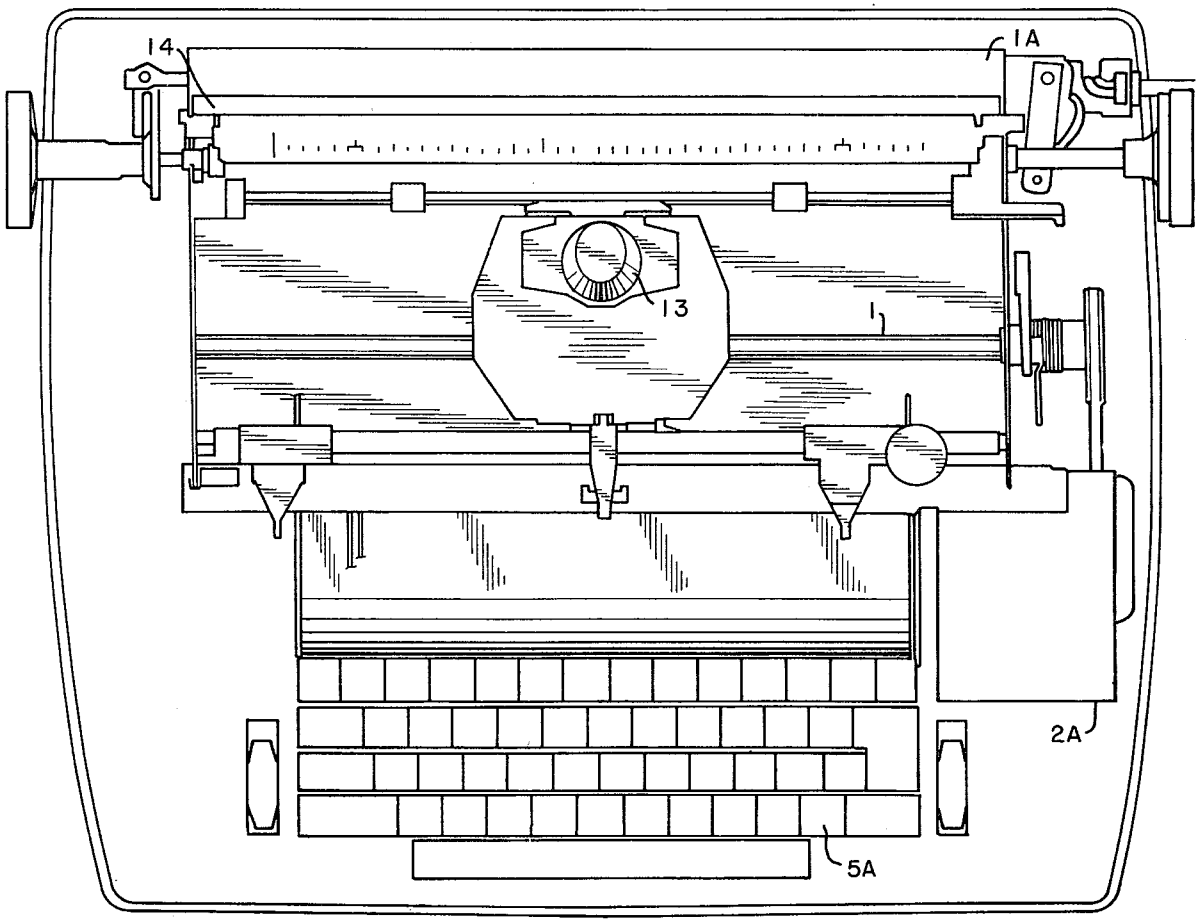
FIG. 8 is a top plan view of a typewriter of the present invention.

Provided on the undersurface of the rocker bracket 12 is a pivot 63, on which are swingably supported four selection levers 64 superposed on one another in the direction of height in opposed relationship to the recess 62 formed on the outer periphery of the rotate pulley 18. As shown in FIG. 6, the selection levers 64 are respectively formed with abutting portions 65A, 65B, 65C and 65D which are located at positions offset from one another in the lateral direction. Additionally, these four selection levers 65A to 65D correspond to four rows of letters disposed in the vertical direction on the type head 13. The recess 62 on the aforesaid rotate pulley 18 corresponds to the specific letters selected from the respective letter positions in the rotational direction of the vertically disposed four rows on the type head 13.

When the bell crank 57 is moved laterally to a position corresponding to one of the abutting portions 65A through 65D of the aforesaid four selection levers 64 and the rocker bracket 12 is rotated upwardly, i.e., in the printing step, the velocity lever 51 is rotated by the spring 52 in the clockwise direction to rotate the bell crank 57 coupled onto the guide rod 54 thereof about the guide rods 55 and 56 in the counterclockwise direction. Thereupon, the engageable portion 61 at the lower end of the bell crank 57 rearwardly urges one of the abutting portions 65A through 65D of a selected selection lever 64, i.e., the selected selection lever 64. At this time, if the aforesaid recess 62 is present at the circumferential position on the rotate pulley 18 corresponding to a projection 66 of this selection lever 64, then the projection 66 enters the recess 62, whereby the selection lever 64 is rotated in the clockwise direction in FIG. 6. Thereupon, the velocity lever 51 engaged therewith through the slot 60 and the guide rod 54 is further rotated in the clockwise direction.

Formed in the upper end portion of the velocity lever 51 is an engageable hole 67, with which the rear end of a control lever 68 is engaged. Formed at the forward end portion of the control lever 68 are stepped abutting portions 69A and 69B positioned within a longitudinal perpendicular surface incorporating an upward movement path of the abutting portion 10C of the trigger 10 coupled onto a shaft 10E provided at the forward end of the aforesaid printing arm 8.

When the printing arm 8 is turned upwardly during printing, the rocker bracket 12 is simultaneously turned upwardly through the agency of the engageable portion 10B of the trigger 10 in the initial step. However, if the rocker bracket 12 is turned to a certain degree, the abutting portion 10C of the trigger 10 impinges on one of the stepped abutting portions 69A and 69B of the control lever 68, whereby the trigger 10 is rotated in the counterclockwise direction, so that the engageable portion 10B can be disengaged from the rocker bracket 12, thus enabling the release of the rocker bracket 12. Thereupon, the rocker bracket 12, after being released, is further turned upwardly to press the type head 13 onto the paper 15 on the platen 14 for printing.

Consequently, when the abutting portion 10C of the trigger 10 impinges on the abutting portion 69A at the lower position (closer position) of the control lever 68, the rocker bracket 12 is released at an earlier stage, i.e., when the printing pressure applied by the type head 13 is comparatively low. In contrast thereto, when the abutting portion 10C of the trigger 10 impinges on the abutting portion 69B at a new higher position (farther position), the rocker bracket 12 is released at a later stage, i.e., when the kinetic energy is comparatively high, whereby the printing pressure applied by the type head 13 becomes comparatively high.

In consequence, when the recess 62 of the rotate pulley 18 comes to a position corresponding to the projection 66 of the selection lever 64 selected, the engageable portion 61 of the bell crank 57 is brought into a state where it can move deeply rearwardly, whereby the bell crank 57 disposed at a position opposed to the abutting portion of the selection lever 64 is brought into a state where it can rotate in the counterclockwise direction. Consequently, the bell crank 57 is rotated in the counterclockwise direction at the same time as the velocity lever 51 rotates in the clockwise direction, and the control lever 68 engaged with the engageable hole 67 of the velocity lever 51 is moved rightwardly (rearwardly), whereby the trigger 10 is brought into a state where it impinges on the abutting portion 69A of the trigger 10 (the state shown in FIG. 4).

When, the recess 62 of the rotate pulley 18 is not present at a position opposed to the projection 66 of the selection lever 64, the engageable portion 61 of the bell crank 57 abuts against the selection lever 64, however, the amount of movement thereof is very small. Consequently, the velocity lever 51 does not turn very much in the clockwise direction, whereby the control lever 68 is at the forward position (left position), so that the abutting portion 69B is at the higher position (farther position), i.e., the printing pressure is comparatively high.

The printing pressure adjustment of the letters in the vertical direction can be selected through the agency of the four selection levers 64, while, the printing pressure adjustment of the letters in the rotational direction can be selected by the circumferential position of the recess 62 of the rotate pulley 18.

Formed in the control lever 68 is a slot 70, with which is engaged the forward end 73 of a manual lever 72 pivotally supported by a pivot 71 of the frame 3 of the carriage 2. Consequently, the manual adjustment of a knob 72A at the upper end of the manual lever 72 in a direction indicated by an arrow A in FIG. 4 makes it possible to vertically move the control lever 68. In other words, the printing pressure level common to all the letters can be adjusted by handling the manual lever 72.

Description will hereunder be given of action of the printing device in the typewriter as described above.

When the key 5A is pressed, the motor 2A causes the main shaft 1 to rotate, whereby the printing cam 5 and the detent cam 6 are rotated.

The printing arm 8 rotates upwardly, following the printing cam 5, and at the same time, the rocker bracket 12 is rotated upwardly. The tilt pulley 21 is turned by a predetermined value in a predetermined direction depending on whether the tilt tape 22 connected to the letter selecting mechanism is pulled or returned by a predetermined length. The connecting arm 30 is vertically moved by a predetermined value in accordance with the turning of the tilt pulley 21, whereby the type head 13 mounted on the tilt link 26 is vertically moved by a predetermined value. Thus the selection of a letter in the vertical direction is performed.

The rotate pulley 18 and the rotate shaft 17 turn by predetermined values depending upon whether the rotate tape 19 connected to the letter selecting mechanism is pulled or returned by a predetermined length. As the result, the ball socket 27 and the type head 13 connected to each other in a manner to be able to impart rotation turn by a predetermined value, so that the selection of a letter in the rotational direction can be performed.

When a letter on the type head 13 identical with the letter of the key is selected upon completion of the abovedescribed vertical and rotational motions, the cam follower 35 riding on detent cam 6 descends (rotates in the counterclockwise direction) in accordance with the shape of the recess 6A of the detent cam 6 as shown in FIG. 3. By this movement, the link 36 moves upwardly, the tilt detent lever 38 rotates about the pivot 37 in the counterclockwise direction, and the end portion 39 of the tilt detent lever 38 is engaged with one of the four grooves 40 selected of the tilt link 26, whereby the type head 13 is indexed in the vertical direction.

Furthermore, along with the rotation of the tilt detent lever 38 in the aforesaid counterclockwise direction, the pin 49 of the lever 38 rises along the slot 48 of the link 46, thereby permitting the link 46 to move upwardly. Thereupon, the rotate detent lever 42 connected to the link 46 is also brought into a state where it can rotate about the pivot 41 in the counterclockwise direction by a predetermined value. Thus, the rotate detent lever 42 turns in the counterclockwise direction, the forward end 44 thereof enters one of the grooves 13A of the type head 13, so that the type head 13 can be indexed in the rotational direction.

Through the abovedescribed steps, a letter on the type head 13 is selected and indexed and the paper 15 on the surface of the platen 14 is struck by the type head 13 through an inked ribbon 15A for printing.

Upon completion of printing, the rocker bracket 12 supporting the type head 13 is restored to the original position shown in FIG. 2 by the reaction upon printing and an urging force of the spring 24.

Furthermore, the detent cam 6 rotates, whereby the cam follower 35 rides up out of the recess 6A and turns in the counterclockwise direction to lower the link 36. Thereupon the tilt detent lever 38 turns in the clockwise direction, whereby the end portion 39, which has been engaged with one of the grooves 40 of the tilt link 26, is disengaged therefrom.

Thereupon, the rotate detent lever 42 is rotated about the pivot 41 in the clockwise direction and disengaged from one of the grooves 13A of the type head 13.

By this, the type head 13 becomes free both in the vertical and rotational directions, the tilt tape 22 and the rotate tape 19 are returned to the waiting positions of the letter selecting mechanism, the parts connected to one another are restored to the waiting positions shown in FIG. 2, and the type head 13 is also returned to the original position.

When a letter in the vertical direction is selected, the tilt pulley 21 rotates, which is utilized to effect the automatic adjustment of the printing pressure for the respective letters.

More specifically, when the tilt pulley 21 turns, the bell crank 57 engaged with the pin 59 on the tilt pulley 21 makes selective sliding motion along the guide rods 55 and 56 in the lateral direction. Due to this sliding motion, the engageable portion 61 of the bell crank 57 comes to a position opposed to any one of the abutting portions 65A through 65D, which is selected, of the four selection levers 64. This position in the lateral direction corresponds to a position of a letter in the vertical direction.

When the rocker bracket 12 turns upwardly during printing, the bell crank 57 rotates in the counterclockwise direction about the guide rods 55 and 56, because the velocity lever 51 having the guide rod 54 coupled into the slot 60 of the bell crank 57 is urged by the spring 52 to rotate in the clockwise direction.

At this time, the engageable portion 61 of the bell crank 57 urges one of the abutting portions 65A through 65D of the selection lever 64. Consequently, when the rotate pulley 18 has rotated to select a letter, if the recess 62 of the rotate pulley 18 is in the position opposed to the projection 66 of the selection lever 64 (a letter having a low printing pressure is selected), the selection lever 64 enters the recess 62, whereby the bell crank 57 further rotates about the guide rods 55 and 56 in the counterclockwise direction. Since the velocity lever 51 can further rotate in the clockwise direction in this case, along with the rotation of the velocity lever 51 in the clockwise direction the control lever 68 engaged therewith is pulled to the right to be brought into a state shown in FIG. 4.

In the state shown in FIG. 4, when the printing arm 8 is turned upwardly by printing operation, the trigger 10 impinges on the abutting portion 69A at the lower position, whereby the printing pressure becomes low.

As apparent from the foregoing, when the recess 62 is not in a circumferential position of the rotatable pulley 18, which is opposed to the projection 66 of a selection lever 64, the control lever 68 is not pulled to the right and remains at a position in the left, whereby the trigger 10 impinges on the abutting portion 69B at the higher position, so that the printing pressure remains high.

During printing, the printing arm 8 is accelerated in the clockwise direction by the spring 11, whereby the rocker bracket 12 engaged therewith is also accelerated. When the rocker bracket 12 is released upon impingement of the trigger 10, the kinetic energy at the time of release is decelerated by a spring 74, provided between the frame 3 and the rocker bracket 12, for urging in an opposite direction and the like. Consequently, the printing pressure applied by the type head 13 can be adjusted depending upon whether the release of the rocker bracket 12 is made at an earlier stage or later stage, i.e., the impingement of the trigger 10 is made at an earlier stage or later stage.

When the adjustment is to be made on the printing pressure level common to all of the letters depending upon the quality of paper, the number of paper sheets to be printed, the manual lever 72 is turned to adjust the height of the control lever 68.

In the abovedescribed embodiment, the adjustment of the printing pressures for the letters in the vertical direction can be selected by use of a plurality of selection levers 64 (the number is four in the illustrated example) arranged in the vertical direction of the type head 13, and the adjustment of the printing pressures for the letters in the rotational direction can be made by the circumferential positions of the recess 62 of the rotate pulley 18.

The mechanism for adjusting the printing pressure as a whole is assembled into the printing device of the carriage 2, and is independent of the key lever mechanism, whereby no complicated transmission mechanism is required, thereby enabling to obtain a printing pressure adjusting device simplified in construction and operable reliably.

Furthermore, parts operating for adjusting the printing pressure are minimized in number and adapted to operate through selecting the vertical and rotational direction positions directly from vertical and rotational direction indexing portions (the tilt pulley 21 and rotate pulley 18), so that a printing pressure adjusting device free from malfunctions can be obtained.

Further, it becomes possible to easily and reliably adjust the printing pressure for any type of type head solely by bringing positions of letters small a in new printing area into registration with the circumferential position of the recess 62 of the rotate pulley 18. Consequently, in manufacturing the printing pressure adjusting device, only a replacement of the cam 6 formed with the recess 6A with a new one depending on the specifications of the type head 13 makes it possible to easily render a printing pressure adjusting mechanism, whereby the necessity of replacing many parts is eliminated, thus facilitating the manufacture.

Moreover, the parts for connecting a mechanism for selecting a letter in the vertical direction of the type head 13 (the tilt pulley 21) to the printing pressure adjusting mechanism are not subjected to an urging force of a spring, whereby the parts operate smoothly and little load acts on the letter selecting mechanism, thereby enabling to simplify the construction of the printing pressure adjusting device.

As apparent from the foregoing, according to the present invention, it becomes possible to obtain a printing pressure adjusting device assembled into a carriage together with a printing mechanism, simplified in construction and operable reliably.

What is claimed is:

1. A printing device in a typewriter comprising:

a rocker bracket turnable in a direction of printing a letter by a cam rotated when a key is pressed;

a type head vertically movably and rotatably supported by said rocker bracket;

a vertically movable pulley and a rotatable pulley which are mounted on said rocker bracket and rotated by a predetermined value in accordance with a letter selected by the key;

a mechanism for transmitting a movement of the vertically movable pulley to the type head to vertically move the type head; and a mechanism for transmitting a movement of the rotatable pulley to the type head to rotate the type head;

wherein said printing device further comprises:

a printing arm for pivotally supporting a trigger detachably engageable with said rocker bracket and abutting against and being rotated by said cam to turn the rocker bracket;

vertical direction selecting means movable to a predetermined position in accordance with a value of rotation of the vertically movable pulley;

rotational direction selecting means provided on the rotatable pulley; and a printing pressure control member movable in accordance with movements of the vertical direction selecting means and the rotational direction selecting means and having at least two abutting portions within a moving path of the trigger;

whereby the position of the printing pressure control member is set by said respective selecting means, and the trigger is caused to impinge on a portion selected out of the abutting portions, so that a position where the rocker bracket is to be released can be adjusted, thereby enabling the adjustment of the printing pressure.

2. A printing device in a typewriter as set forth in claim 1, wherein said trigger is urged toward a position of engagement with said rocker bracket by a resilient force, said printing arm is urged in a direction of printing a letter by a resilient force higher than that of said trigger, and, when said cam is turned to a printing position to release said printing arm, said printing arm is moved to the printing position against the resilient force of the trigger.

3. A printing device in a typewriter as set forth in claim 1, wherein a tilt link is vertically movably supported on said rocker bracket, and said type head is rotatably supported on said link.

4. A printing device in a typewriter as set forth in claim 3, wherein said vertical direction selecting means is a connecting arm provided between a position offset from the center of said vertically movable pulley and said tilt link.

5. A printing device in a typewriter as set forth in claim 1, wherein said rotational direction selecting means includes a rotate shaft rotatable integrally with said rotatable pulley and a ball joint for connecting said rotate shaft and said type head.

6. A printing device in a typewriter as set forth in claim 1, wherein said cam comprises a printing cam and further comprises a detent cam and said printing and detent cams both rotate during printing operation, and wherein vertical movement of said printing arm is controlled by said printing cam, and the type head placed at a predetermined printing position by the vertical rotational direction selecting means is positioned at said printing position by an indexing mechanism operated by said detent cam.

7. A printing device in a typewriter as set forth in claim 6, wherein said indexing mechanism comprises: vertical direction indexing means engageable with one of a plurality of positioning grooves of a tilt link vertically movably supporting said type head; and rotational direction indexing means engageable with one of a plurality of positioning grooves circumferentially formed on said type head.

8. A printing device in a typewriter as set forth in claim 1, wherein said printing pressure control member is operated by an operating mechanism including: a plurality of selection levers controlled in position by a recess formed at a predetermined circumferential position of said rotatable pulley; a bell crank engageable with one of said selection levers and movable by said vertically movable pulley; a velocity lever engageable with said bell crank; and a spring for urging said velocity lever in one direction; whereby a letter, for which the printing pressure is to be adjusted, is selected by positions of said recess of the rotatable pulley and said bell crank.

* * * * *